US011313643B2

(12) United States Patent
Yollu

(10) Patent No.: US 11,313,643 B2
(45) Date of Patent: Apr. 26, 2022

(54) FOLDING STOCK ASSEMBLY FOR FIREARMS

(71) Applicant: ATA SILAH SANAYI ANONIM SIRKETI, Istanbul (TR)

(72) Inventor: Fatih Yollu, Istanbul (TR)

( * ) Notice: Subject to any disclaimer, the term of this patent is extended or adjusted under 35 U.S.C. 154(b) by 0 days.

(21) Appl. No.: 17/256,679

(22) PCT Filed: Oct. 7, 2019

(86) PCT No.: PCT/TR2019/050832

§ 371 (c)(1),
(2) Date: Dec. 29, 2020

(87) PCT Pub. No.: WO2021/040638

PCT Pub. Date: Mar. 4, 2021

(65) Prior Publication Data

US 2021/0372730 A1 Dec. 2, 2021

(30) Foreign Application Priority Data

Aug. 27, 2019 (TR) ..... 2019/12957

(51) Int. Cl.
*F41C 23/04* (2006.01)

(52) U.S. Cl.
CPC ..... *F41C 23/04* (2013.01)

(58) Field of Classification Search
CPC ..... F41C 23/04; F41C 23/14; F41C 27/06; F41A 3/84; F41A 11/02; F41A 3/66; F41A 11/04; F41A 19/10; F41A 3/26; F41A 35/06
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS 8,656,623 B1 * 2/2014 Chvala ..... F41C 23/04 42/75.03
8,915,005 B2 * 12/2014 Grimshaw ..... F41C 23/04 42/73
8,955,245 B2 * 2/2015 Chvala ..... F41C 23/14 42/73
8,955,422 B1 * 2/2015 Schumacher ..... F41A 5/02 89/198
8,991,088 B1 * 3/2015 Young ..... F41A 25/00 42/75.03
9,228,795 B1 * 1/2016 Kielsmeier ..... F41C 23/04
9,347,738 B1 * 5/2016 Schumacher ..... F41A 3/26
(Continued)

FOREIGN PATENT DOCUMENTS

CN 110132056 A 8/2019
TR 200400602 U 8/2004
(Continued)

OTHER PUBLICATIONS

International Search Report for corresponding PCT/TR2019/050832, dated Jun. 22, 2020.
(Continued)

*Primary Examiner* — Michael D David
(74) *Attorney, Agent, or Firm* — Egbert, McDaniel & Swartz, PLLC

(57) ABSTRACT

A folding stock assembly for firearms can be easily folded to the left or right without the use of any additional tools for ease of handling and ergonomics in sniper or tactical weapons.

8 Claims, 7 Drawing Sheets

(56) References Cited

U.S. PATENT DOCUMENTS

| | | | | |
|---|---|---|---|---|
| 9,459,060 | B2 * | 10/2016 | Langevin | F41A 3/84 |
| 9,488,434 | B2 * | 11/2016 | Kielsmeier | F41C 23/20 |
| D779,018 | S * | 2/2017 | Zayatz | D22/108 |
| D781,392 | S * | 3/2017 | Zayatz | D22/108 |
| 9,664,478 | B2 * | 5/2017 | Robinson | F41C 23/14 |
| D792,936 | S * | 7/2017 | Eitan | D22/108 |
| D792,937 | S * | 7/2017 | Eitan | D22/108 |
| D798,984 | S * | 10/2017 | Roberts | D22/108 |
| 9,823,031 | B2 * | 11/2017 | Robbins | F41A 11/02 |
| D828,476 | S * | 9/2018 | Smith | D22/108 |
| 10,119,781 | B1 * | 11/2018 | Teetzel | F41C 27/06 |
| 10,156,421 | B2 * | 12/2018 | Smith | F41C 23/08 |
| 10,371,474 | B2 * | 8/2019 | Young | F41A 3/84 |
| 10,578,396 | B2 * | 3/2020 | Teetzel | F41A 19/10 |
| 10,704,848 | B1 * | 7/2020 | Zeider | F41A 3/84 |
| 11,035,646 | B2 * | 6/2021 | Teetzel | F41C 27/06 |
| 2011/0131857 | A1 | 6/2011 | Kuczynko et al. | |

FOREIGN PATENT DOCUMENTS

| | | | |
|---|---|---|---|
| TR | 201101744 | U | 4/2011 |
| TR | 201508545 | U | 9/2015 |
| WO | 2006115703 | A2 | 11/2006 |

OTHER PUBLICATIONS

Written Opinion of the International Searching Authority for corresponding PCT/TR2019/050832, dated Jun. 22, 2020.

* cited by examiner

FOLDING STOCK ASSEMBLY FOR FIREARMS

TECHNICAL FIELD

The invention relates to a folding stock assembly for use in firearms, in which the folding direction can be changed quickly by hand without the use of any tools.

In particular, the invention relates to a folding stock assembly for firearms that can be easily folded to the right or left without the use of any additional tools in order to provide ease of handling and ergonomics in sniper or tactical weapons.

BACKGROUND OF THE INVENTION

Firearms such as pistols, rifles and bombs are known as structures commonly used in hunting and defense industries. It is of great importance that the stock portion of the gun can be folded in such structures as firearms, such as rifles fired on the shoulder.

A lot of auxiliary equipment and accessories are used to make the shots fired by users instant or predetermined target more stable and more accurate.

Some of the firearms used today are used with fixed chassis or fixed stock and some of them can be folded on the main body of the rifle by using various folding mechanisms.

It provides ease of handling and ergonomics, especially in weapons used for sniper or tactical purposes. Because different people use these rifles, users have variable requests. The direction of the folding stock may also be desirable to different parties according to the user's preferred direction.

Although there are already systems to meet these demands, the stock folding direction can be changed after assembly/disassembly process, tools are used and the work is slowed down. This leads to problems such as the loss of dismantled parts, the necessity of transporting spare parts and the necessary tools, and makes it impossible to change direction and fold to the desired side when time is limited.

In the literature, TR 2011 01744 numbered utility model application related to the subject "There is a cartridge on the pistol grip. The right-hand and left-handed cartridge slots on both sides of the pistol grip anchor form the side cartridges. The cartridge slots located on the upper side of the pistol grip anchor form the upper cartridges. The pistol grip is designed as a spring. Therefore, the cartridge part of the pistol grip anchor—when the tab is open and parallel to the ground—corresponds to a level lower than the shoulder and pistol grip. As a result, neither the cartridges nor the side and top cartridges come into contact with the rifle barrel when the stock is closed. As a result, when the stock is open, the user can take aim and use the rifle in a healthy way, despite the cartridges installed in the cartridges."

Said application discloses a rifle assembly comprising a folding stock configuration.

In the literature TR 2004 00602 numbered utility model application relates to "The present invention relates to "Folding stock with carrying function for rifles". Spring-locking in both positions, which allows the rifle to be carried by hand in the folded position, the handle section is covered with elastic material, has an eccentric shoulder sleeve, movable around the central pin backwards (from the shoulder to the aiming position) and forward (hand to shoot and carrying position) button with folding stock."

In said embodiment, a folding stock structure having a portable structure is provided.

Again in the literature TR 2015 08545 useful model application related to the subject "Automatic, semi-automatic and air rifle stock, feature; the engagement adjustment holes and the pivot axis hole formed on said main collector body, the auxiliary body accommodating the engagement adjustment and lock, the butt hinge and the stock retaining hinge connected to said engagement adjustment and the lock accommodating auxiliary body. the locking system that prevents the opening movement caused by the shot."

In the said application, a folding stock structure which can be adjusted for aiming is provided.

Due to the aforementioned disadvantages there was a need to provide a new folding stock configuration for firearms.

DISCLOSURE OF THE INVENTION

From this position of the art, it is an object of the invention to provide a new folding stock structure for firearms which eliminates the present disadvantages.

Another object of the invention is to provide a structure which provides ease of transportation and ergonomics in sniper or tactical weapons.

Another object of the invention is to provide a structure which can be folded on both sides.

Another object of the invention is to provide double-sided folding process in firearms with the help of a long time to eliminate the problem is to reveal a structure.

Another object of the invention is to provide a structure which allows the users to make stock folding in a much shorter time.

REFERENCE NUMBERS

Figure 1:
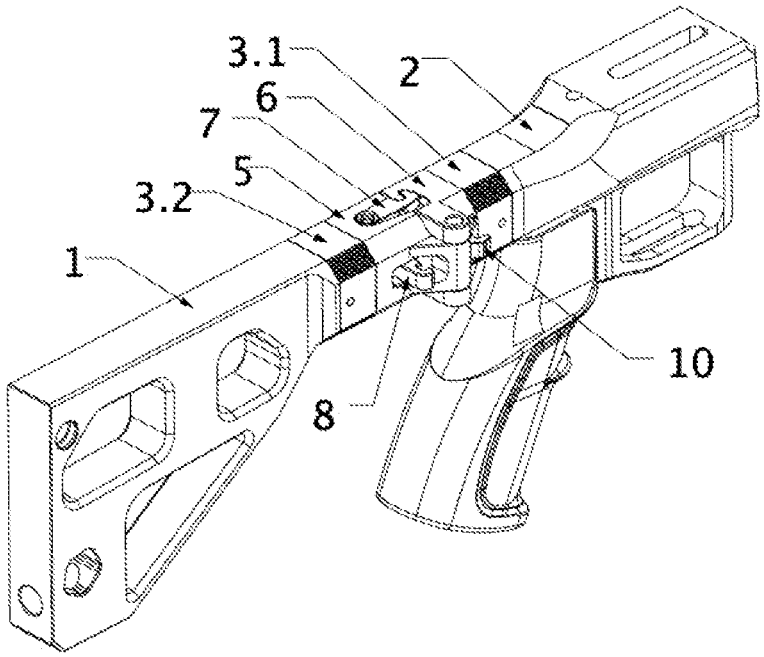
FIG. 1 is a perspective view of the folding stock assembly according to the invention.

A—Folding Stock Assembly
1. Stock
2. Body
3.1 First Changeover Lever

3.2 Second Changeover Lever
4.1 First Direction Fixing Pin
4.2 Second Direction Fixing Pin
5. Hinge
6. Axis
7. Folding Tab
8. Folding Lock
9.1 First Centering Shaft
9.2 Second Centering Shaft
10. Lock Holder
11.1 First Direction Fixing Pin Hole
11.2 Second Direction Fixing Pin Hole
12.1 First Pin Hole Spring
12.2 Second Pin Hole Spring
13. Folding Button

DETAILED DESCRIPTION OF THE INVENTION

In this detailed description, the invention is described with examples that will not have any limiting effect for better understanding of the subject matter.

The invention is a folding stock assembly (A) for firearms comprising at least one body (2) and stock (1), which can be easily folded to the left or right without the use of any additional tools for ease of handling and ergonomics in sniper or tactical weapons characterized in that; comprises a hinge (5) formed between said stock (1) and the body (2) which allows said stock (1) to be folded, the axis (6) positioned in connection with said hinge (5), the folding tabs (7) formed on the hinge (5) and fixing said hinge (5) on said axis (6), the folding button (13) which allows said folding tab (7) to be opened by releasing the slot formed on the axis (6), a first changeover lever (3.1) positioned between the body (2) and the axis (6) to change the folding direction of said stock (1).

FIG. 1 shows a perspective view of the folding stock assembly (A) according to the invention.

Figure 2:
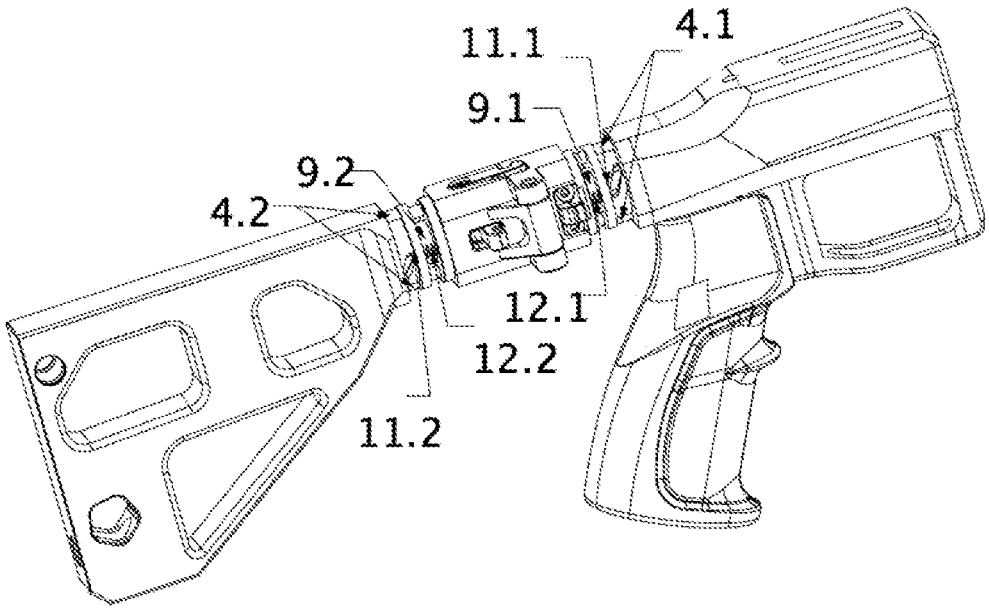
FIG. 2 is a side view of the folding stock assembly according to the invention.

FIG. 2 shows a side view of the folding stock assembly (A) according to the invention.

Figure 3:
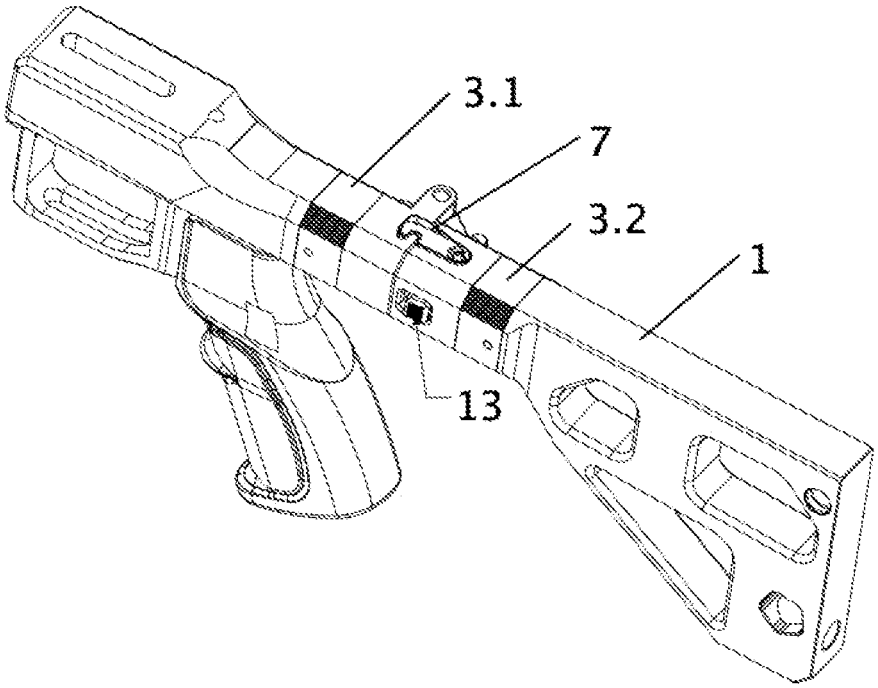
FIG. 3 is another perspective view of the folding stock assembly according to the invention

FIG. 3 shows another perspective view of the folding stock assembly (A) according to the invention.

Figure 4:
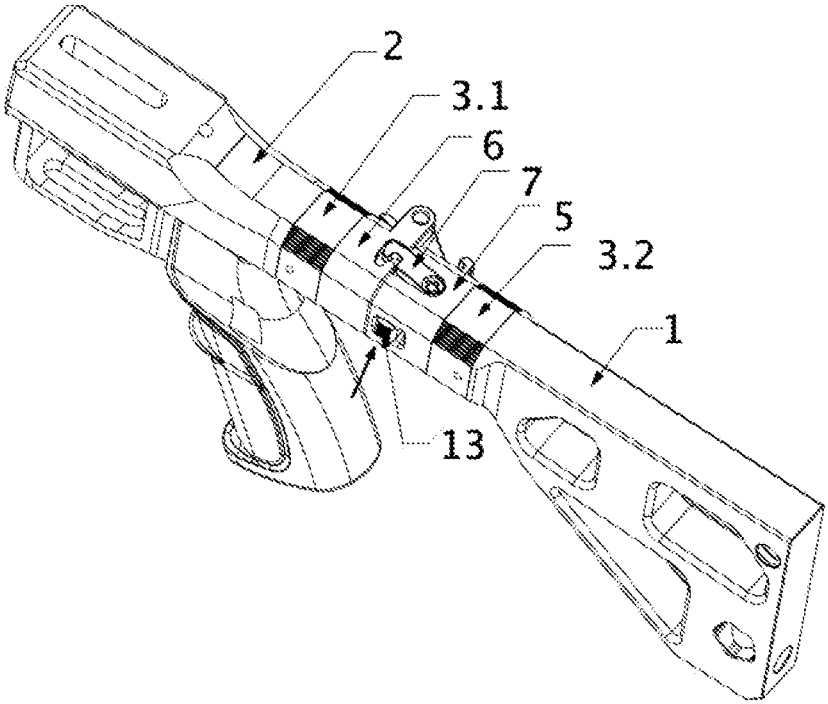
FIG. 4 is another top perspective view of the folding stock assembly according to the invention FIG. 5—is a folded view of the folding stock assembly according to the invention.

FIG. 4 shows another top perspective view of the folding stock assembly (A) according to the invention.

Figure 5:
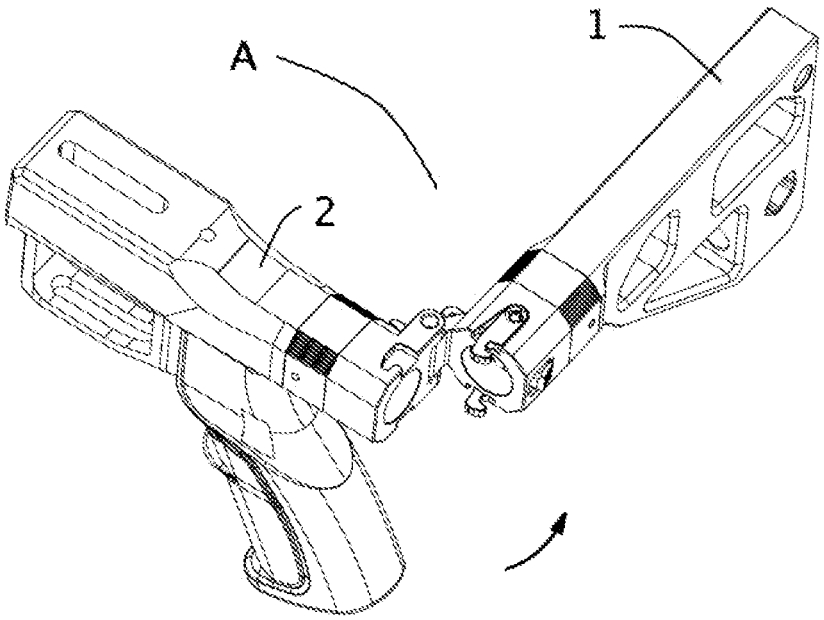

FIG. 5—shows a folded view of the folding stock assembly (A) according to the invention.

Figure 6:
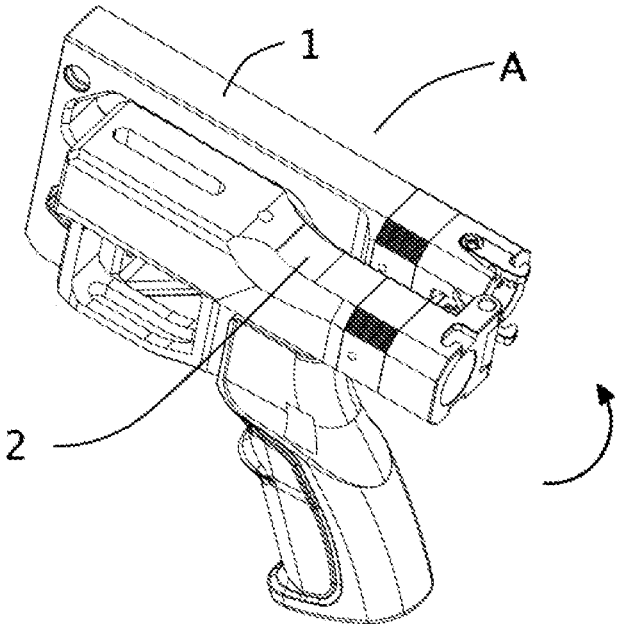
FIG. 6 is another folded view of the folding stock assembly according to the invention

FIG. 6 shows another folded view of the folding stock assembly (A) according to the invention.

Figure 7:
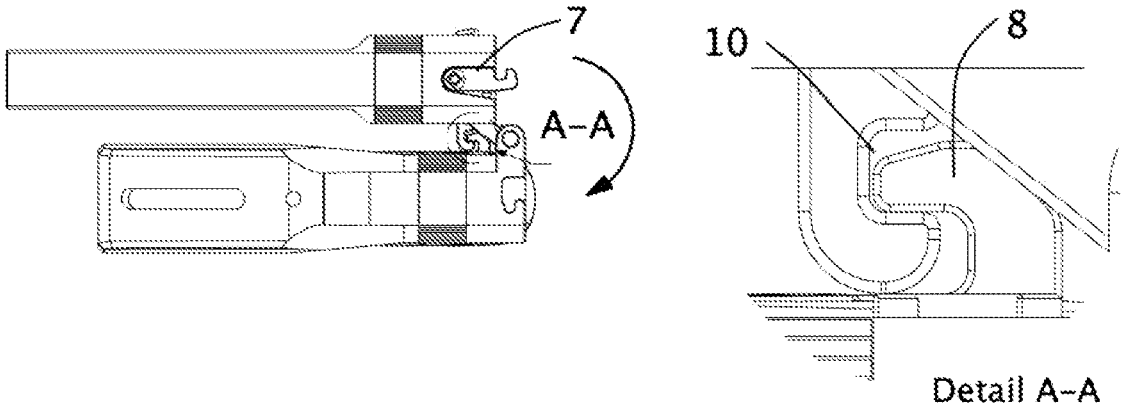
FIG. 7 is a folded top detail view of the folding stock assembly according to the invention

FIG. 7 shows a folded top detail view of the folding stock assembly (A) according to the invention.

Figure 8:
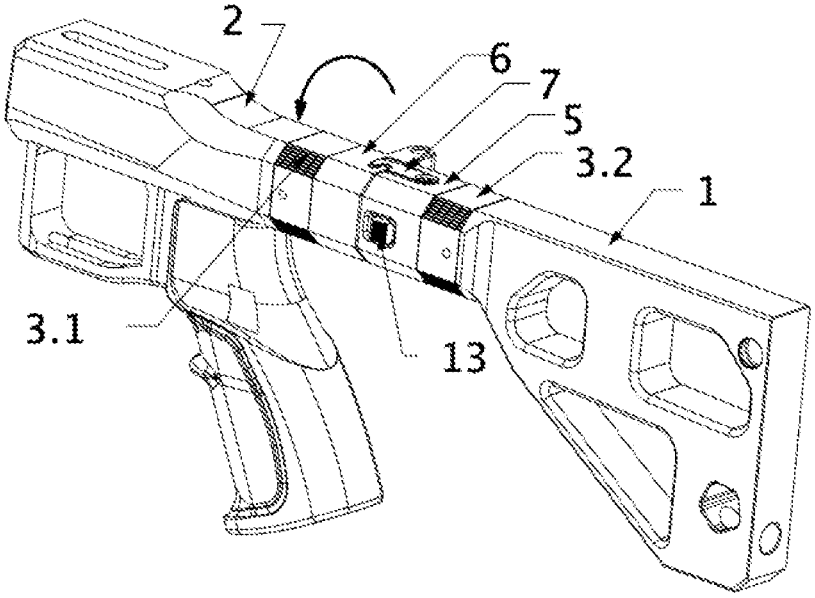
FIG. 8 is another view of the folding stock assembly according to the invention

FIG. 8 shows another view of the folding stock assembly (A) according to the invention.

Figure 9:
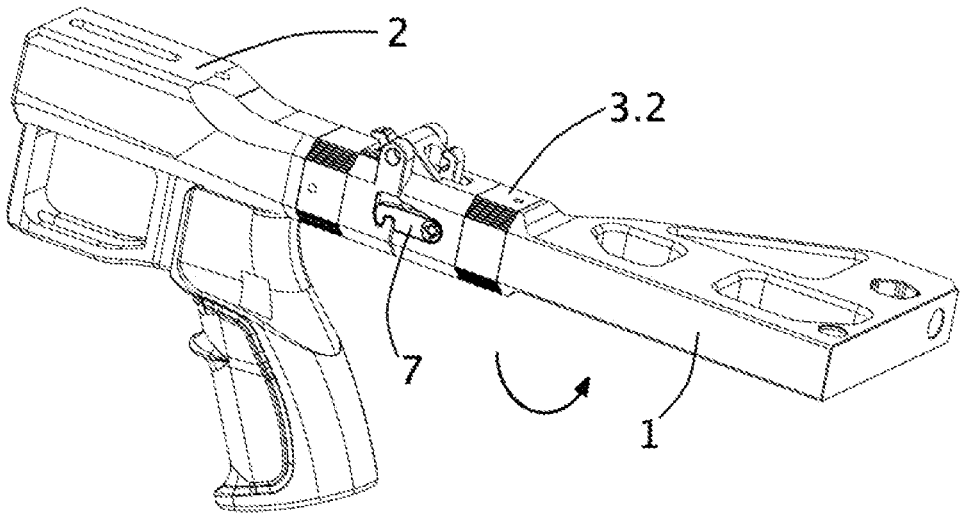
FIG. 9 is another view of the folding stock assembly according to the invention

FIG. 9 shows another view of the folding stock assembly (A) according to the invention.

Figure 10:
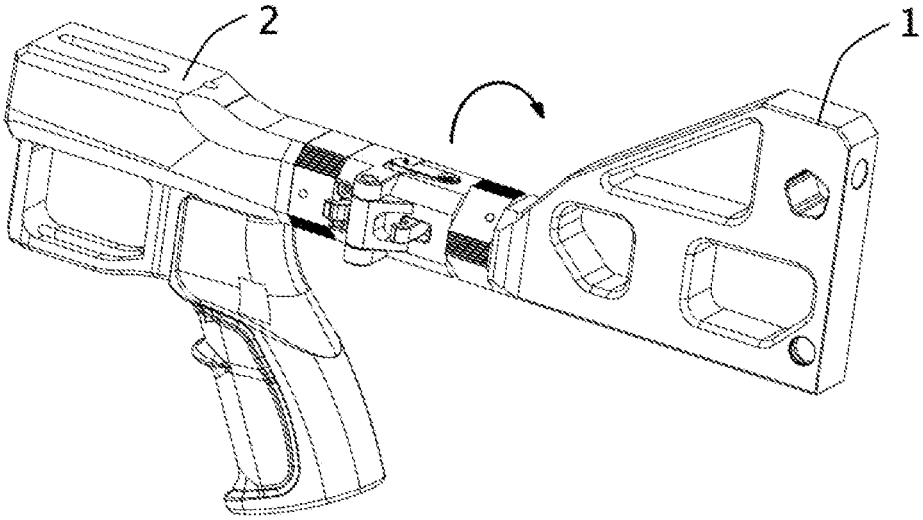
FIG. 10 is another view of the folding stock assembly according to the invention

FIG. 10 shows another view of the folding stock assembly (A) according to the invention.

Figure 11:
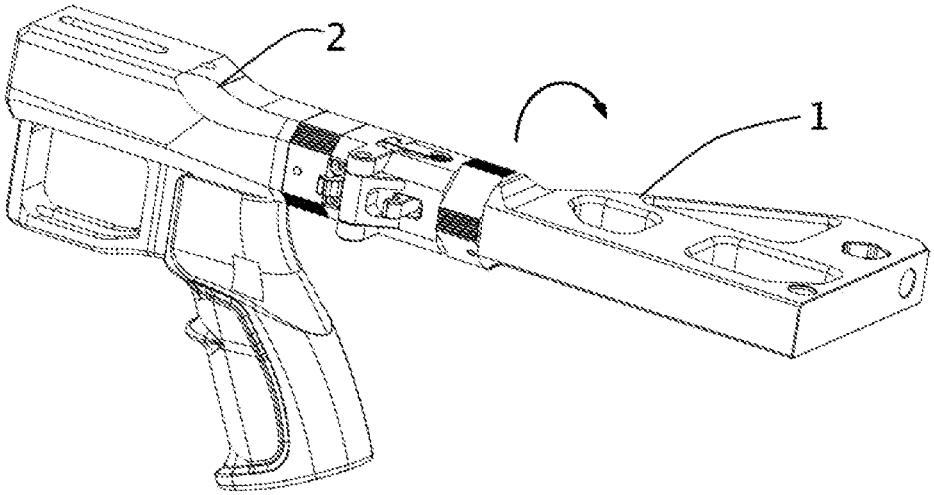
FIG. 11 is another view of the folding stock assembly according to the invention

FIG. 11 shows another view of the folding stock assembly (A) according to the invention.

Figure 12:
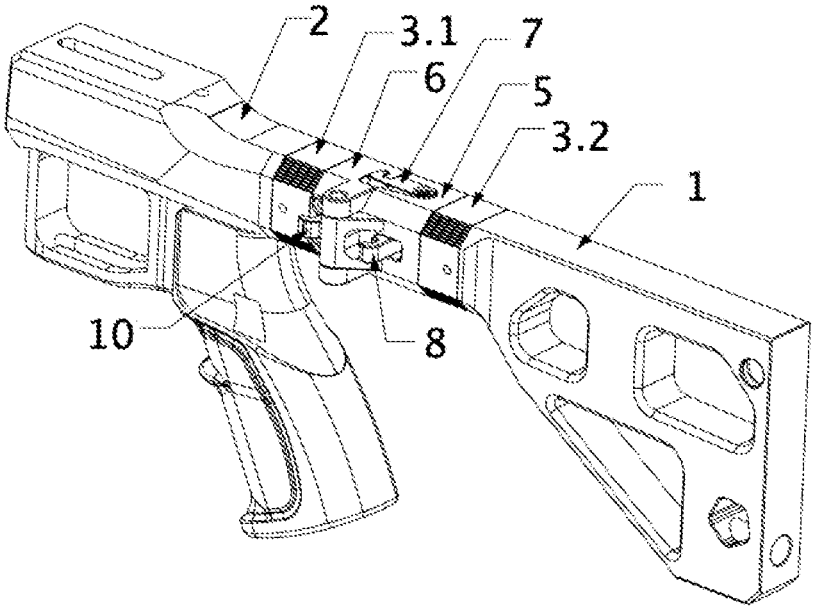
FIG. 12 is another view of the folding stock assembly according to the invention

FIG. 12 shows another view of the folding stock assembly (A) according to the invention.

Figure 13:
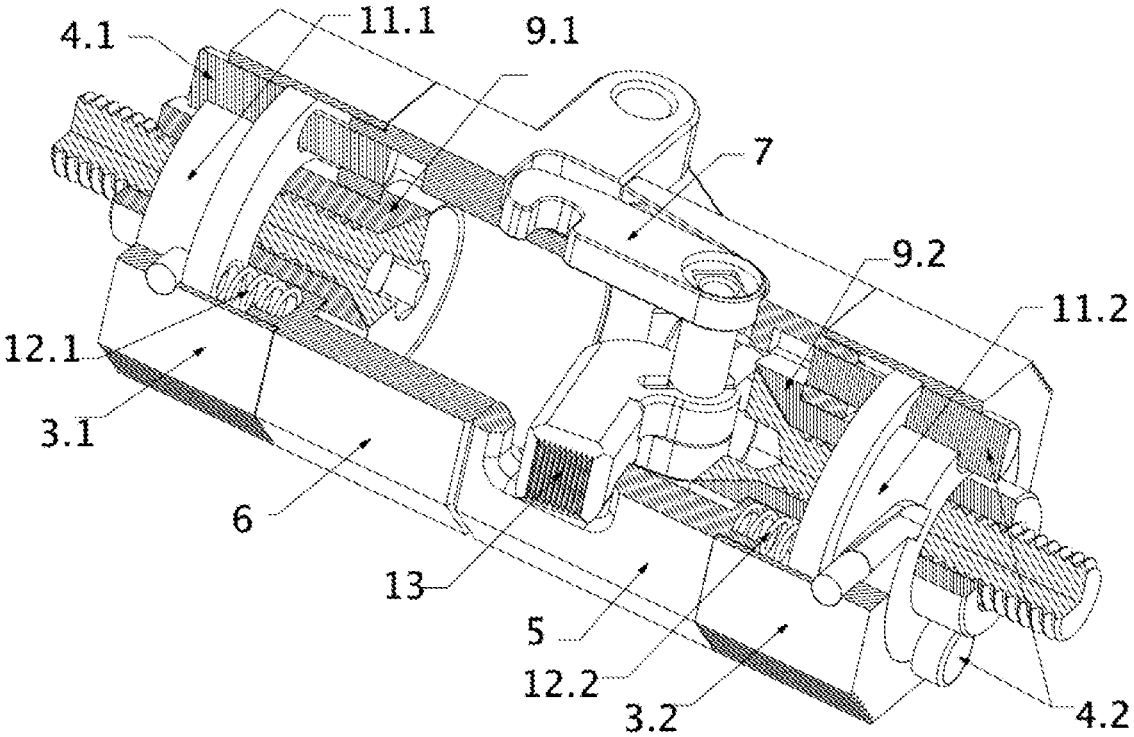
FIG. 13 is a cross-sectional view of the folding stock assembly according to the invention

FIG. 13 shows a cross-sectional view of the folding stock assembly (A) according to the invention.

The folding stock assembly (A) according to invention; consists of main parts that, body (2) formed in the middle section of the firearm, stock (1) associated with said body (2), comprises a hinge (5) formed between said stock (1) and the body (2) which allows said stock (1) to be folded, the axis (6) positioned in connection with said hinge (5), the folding tabs (7) formed on the hinge (5) and fixing said hinge (5) on said axis (6), the folding button (13) which allows said folding tab (7) to be opened by releasing the slot formed on the axis (6), the folding lock (8) formed on said hinge (5) in order to prevent it from involuntarily re-opening when said stock (1) is folded onto the body (2), the lock holder (10) formed on said axis (6) as the place where said folding lock (8) is housed, a first changeover lever (3.1) positioned between the body (2) and the axis (6) to change the folding direction of said stock (1), a second changeover lever (3.2) positioned between the stock (1) and the hinge (5) to change the folding direction of said stock (1), a first centering shaft (9.1) allowing said first changeover lever (3.1) to rotate about its axis; a second centering shaft (9.2) allowing said second changeover lever (3.2) to pivot about its axis; the first direction fixing pin (4.1) and the second direction fixing pin (4.2) ensuring that said stock (1) is fixed in the first position, a first direction fixing pin hole (11.1) accommodating said first direction fixing pin (4.1), a second direction fixing pin hole (11.2) bearing said second direction fixing pins (4.2), the first pin hole spring (12.1) performing the re-fixing operation by pushing the first direction fixing pin hole (11.1) and the second pin hole spring (12.2) performing the re-fixing operation by pushing the second direction fixing pin hole (11.2).

When the user presses the folding button (13), the folding tabs (7) formed on the hinge (5) are opened and said stock (1) is folded in the right or left direction.

When the folding is performed, said folding lock (8) is locked to the lock holder (10) to prevent the stock (1) from being opened back on said body (2).

When said folding button (13) is pressed again, the folding lock (8) is released from the lock holder (10) and returned to its original position.

To change the folding direction, the first changeover lever (3.1) is rotated slightly about the first centering shaft (9.1) and the system is completely disengaged when the first direction fixing pin hole (11.1) moves from the body (2) by moving with the first direction fixing pin (4.1) is beginning to spin.

When it completes its 180 degree rotation, the first direction fixing pin (4.1) re-fix the system by the first pin hole spring (12.1) pushing the first direction fixing pin hole (11.1).

The user then rotates the second changeover lever (3.2) a little in order to rotate the remaining stock (1) and when the second direction fixing pins (4.2) move away from the stock (1), the stock (1) starts to rotate.

When said stock (1) completes its 180 degree rotation, the second direction fixing pins (4.2) fix the stock (1) again and change the direction.

The invention claimed is:

1. A folding stock assembly for a firearm, the folding stock assembly comprising:

a body;

a stock hingedly connected to said body so as to be selectively foldable to both sides of said body;

a hinge formed between said stock and said body, said hinge defining an axis of rotation;

a plurality of folding tabs formed on said hinge so as to fix the axis of rotation of said hinge;

a folding button cooperative with said plurality of folding tabs so as to allow said plurality of folding tabs to be opened by releasing a slot formed on the axis of rotation;

a first changeover lever positioned between the body and the axis of rotation so as to allow said stock to be folded to one of the both sides of said body;

a first direction fixing pin positioned between said stock and said body and receivable in a first direction fixing pin hole formed on one side of said stock and said body when said stock is folded to one of the both sides; and a second direction fixing pin positioned between said stock and said body and receivable in a second direction fixing pin hole formed on one of said stock and said body when said stock is folded to another of the both sides.

2. The folding stock assembly of claim 1, further comprising:

a second changeover lever positioned between said stock and said hinge so as to change a direction of folding of said stock.

3. The folding stock assembly of claim 1, further comprising:

a folding lock formed on said hinge so as to prevent said hinge from opening when said stock is folded to one of the both side.

4. The folding stock assembly of claim 3, further comprising:

a lock holder formed on the axis of rotation and at where said folding lock is housed.

5. The folding stock assembly of claim 2, further comprising:

a first centering shaft cooperative with said first changeover lever so as to allow said first changeover lever to rotate.

6. The folding stock assembly of claim 5, further comprising:

a second centering shaft cooperative with said second changeover lever so as to allow said second changeover lever to rotate.

7. The folding stock assembly of claim 1, further comprising:

a first pin hole spring positioned so as to urge against the first direction fixing pin hole.

8. The folding stock assembly of claim 7, further comprising:

a second pin hole spring positioned so as to urge against the second direction fixing pin hole.

* * * * *